US005330181A

United States Patent [19]

Wong

[11] Patent Number: 5,330,181

[45] Date of Patent: Jul. 19, 1994

[54] CROSSHANDLED BATON WITH CONSTRAINING MEANS

[76] Inventor: John K. Wong, 607 E. Tennessee St., Fairfield, Calif. 94533

[21] Appl. No.: 991,151

[22] Filed: Dec. 16, 1992

[51] Int. Cl.[5] ..... F41B 15/02

[52] U.S. Cl. ..... 273/84 R; 30/295

[58] Field of Search ..... 273/84 R, 84 ES; 30/295, 312, 313; D8 DIG. 5, DIG. 7; D22/118

[56] References Cited

U.S. PATENT DOCUMENTS

| | | | |
|---|---|---|---|
| 4,460,174 | 7/1984 | Perry | 273/84 R |
| 4,492,377 | 1/1985 | Eby | 273/84 R |
| 4,506,889 | 3/1985 | Lewis | 273/84 R |
| 5,108,097 | 4/1992 | Ashihara | 273/84 R |
| 5,118,108 | 6/1992 | Wilmoth | 273/84 R |

*Primary Examiner*—V Millin
*Assistant Examiner*—William M. Pierce
*Attorney, Agent, or Firm*—Harold D. Messner

[57] ABSTRACT

The present invention relates to an elongated main branch of a baton having a longitudinal axis and a cross branch normal to the main branch, the cross branch being located near one end of the main branch. The cross branch also has a longitudinal axis that is coplanar to the axis of the main branch. Construction is as follows: the main branch and the cross handle usually are of an unitary construction in which a major length of the main branch (and the cross handle) are of a solid, one-piece construction but wherein at least a minority of the length of the main branch is provided with a cavity means. The cavity means of the invention can take the following form: For example, in one aspect of the invention there is at least a first portion of the cavity means that is located at the one end of the main branch adjacent to the cross branch, into which is fitted with an elongatable strap in the form of a chain or rope of constant weight per length. An end of the strap is next attached to a detachable, weighted end cap that forms an end wall of the first portion of the cavity means when the end cap is attached to the main branch of the baton. The strap and weighted end cap thus can define both active and inactive states relative to the cavity means wherein in the inactive state, the strap is completely stowed within the first portion of the cavity means and the end cap is attached at one end of the cavity means. In the active state, a majority of the strap extends from the first portion of the cavity means along with a detached weighted end cap.

14 Claims, 4 Drawing Sheets 70
6
6
15
11
10
35
37
41
43
43
45
40
43
44
32
43

4
17
54
59
21
65
25'
30
55
60
51
50
64
66
53
4

85
14
12
83
84
86
P
7
14
22
19a
20
24
19
16
18
17
23
19b
35
26
25
30
32
13
27
7

CROSSHANDLED BATON WITH CONSTRAINING MEANS

SCOPE OF THE INVENTION

The present invention relates to crosshandled police batons and more particularly to such batons having a cavity segment supporting a strap of sufficient length and weight which can assist in disarming and apprehending a suspect.

BACKGROUND OF THE INVENTION

A conventional police baton is a club which is typically about two-feet long and about one inch in diameter. Such baton is made from wood, hard rubber or a plastic material. The baton is gripped at one end and is used in a sweeping or jabbing motion in disarming and apprehending a suspect.

U.S. Pat. No. Des. 230,150 discloses a branched short handle secured at right angles to the main branch. The user can grip the baton by the short handle and is thus able to perform a horizontal swinging motion, by allowing the cross handle to turn in the user's hand. The baton achieves significantly greater velocity during a swing stroke because the rotational speed is added to the speed of the swinging motion.

U.S. Pat. No. 4,132,409 discloses a crosshandled baton in which the branched short handle is pivotal relative to the main branch. A sleeve is provided on a shank over half of the branched short handle nearest the main branch. By loosening the grip on the outer half of the branched short handle while maintaining a firm grip on the inner half (between thumb and index finger) the baton will pivot freely in the rotatable sleeve without any risk of the short handle working up out of the user's hand. Another possible use of the crosshandle is as a hook as set forth in U.S. Pat No. 4,703,932. The user can reach out the baton and hook a limb of the person by the branched short handle. However, the force which a limb exerts against the baton may be such as to cause the user's hand holding the baton to be twisted, allowing the baton to move away from the limb being engaged. In that manner, the suspect may easily disengagement himself from control via the baton.

U.S. Pat. No. 4,964,636 relates to a crosshandled baton in which the branched short handle is provided with a trigger wherein its rotational capability is controlled by the user. Result: the user can control the baton with either hand because of the position of the trigger that delatches the short handle from the main branch. In addition, the main body could be formed with an interior cavity. The purpose is many-fold: to reduce the weight of the baton, support telescoping cylinders within the cavity, support movable lead beads or shot that travels toward the tip of the baton and support a tear gas canister.

However, often such hollow construction leads to disadvantages when such batons are used in actual disarming situations. For example, the cavity may reduced the weight of the baton below that desired in using the baton in its usual jabbing and/or swinging maneuvers. The addition of movable elements (when the latter are fitted within the cavity), may make the baton difficult to use. For example, when the baton is used in a swinging or jabbing mode of operation, the sudden addition of momentum due to relative movement to such elements toward the end of the baton, may makes the balance of the baton uneven and lead to difficulties in the user controlling the amount of force the baton delivers to the suspect's body, especially where the user is involved in a confrontational situation where circumstances facing the user change rapidly with time.

SUMMARY OF THE INVENTION

The present invention relates to an elongated main branch of a baton having a longitudinal axis and a cross branch normal to the main branch, the cross branch being located near one end of the main branch and being of less length than the main branch. The cross branch also has a longitudinal axis that is coplanar to the axis of the main branch. Construction is as follows: the main branch and the cross handle usually are of an unitary construction in which a major length of the main branch (and the cross handle) are of a solid, one-piece construction but wherein at least a minority of the length of the main branch is provided with a cavity means. The cavity means of the invention can take the following form: For example, in one aspect of the invention there is at least a first portion of the cavity means that is located at the one end of the main branch adjacent to the cross branch, into which is fitted with an elongatable strap in the form of a chain or rope of constant weight per length. An end of the strap is next attached to a detachable, weighted end cap that forms an end wall of the first portion of the cavity means when the end cap is attached to the main branch of the baton. The strap and weighted end cap thus can define both active and inactive states relative to the cavity means wherein in the inactive state, the strap is completely stowed within the first portion of the cavity means and the end cap is attached at one end of the cavity means. In the active state, a majority of the strap extends from the first portion of the cavity means along with a detached weighted end cap. However note that the present invention also includes a second portion of the cavity means can also be formed at an opposite end of the main branch of the baton into which is provided a weighted head probe.

Features of the strap, weighted end cap and weighted head probe: they allow a suspect to be restrained as when the strap and weighted end cap are used in its active state (say, where the weighted end cap is detached from the baton and the strap is tied to an appendage of the suspect), yet when the strap is in a stowed state and the weighted end cap is attached to the baton, i.e., in a inactive state, the weighted head probe provides a suspect-jabbing construction that is highly functional yet in combination with the strap and weighted end cap does not unbalance the baton because the ratio of weights of these elements are within a reasonable range.

In more detail, an interior end of the strap is fixedly attached to a pin radially spanning the side wall of the first portion of the cavity means. Such interior end is permanently positioned adjacent to the end wall of the first portion of the cavity means and remains affixed relative to the main branch during all states of baton operation.

The construction of the pin is such as to have enlarged ends that are positioned exterior of diametrically disposed openings in the side wall of the first portion of the cavity means.

In its inactive state, the strap is folded and stowed completely within the first portion. The length and dimensions of the strap are engineered and constructed such that there is very little movement in such inactive state (relative to the side wall of the first portion). Hence during swinging or jabbing use of the baton, the balancing point of the baton remains essentially constant. That is, the balance of the baton remains even though the strap has been added to the baton. The other end of the strap connects to a weighted end cap via a second pin, such weighted end cap being releasably connected to the side wall of the first portion of the cavity means as by interconnecting threads or by a spring-loaded latch those operational state (latched or unlatched) mimics the operational state of the chain ("active" or "elongatable" and "inactive" or "stowable").

Further features of the invention: The ratio of the weight of the weighted end cap W1 versus that of the strap W2 versus that of the weighted head probe W3 are related as follows. Assume that R1 is the ratio of W1/W2 and R2 is the ratio of W2+W1/W3, then R1 is about equal to R2 and either is in the range of ½ to 2 with R1=R2=1 being preferred. The second pin has a longitudinal axis of symmetry coincident with that of the cavity. Finally, note that there is also a relationship between different segments of the baton. For example, assume that L1 is the length of first portion of the cavity means plus excess cantilevered length of the weighted end cap, L2 is the length of the second portion of the cavity means plus excess cantilevered length due to the weighted head probe, and L3 is the remaining length of the main branch of the baton, then Li is in the range of 7 to 11 inches, L2 is in the range of 1 to 3 inches and L3 is in the range of 14 to 22 inches. The length L4 of the strap is the range of 28 to 32 inches.

DETAILED DESCRIPTION OF EMBODIMENTS OF THE INVENTION

Figures 1, 2, 3:
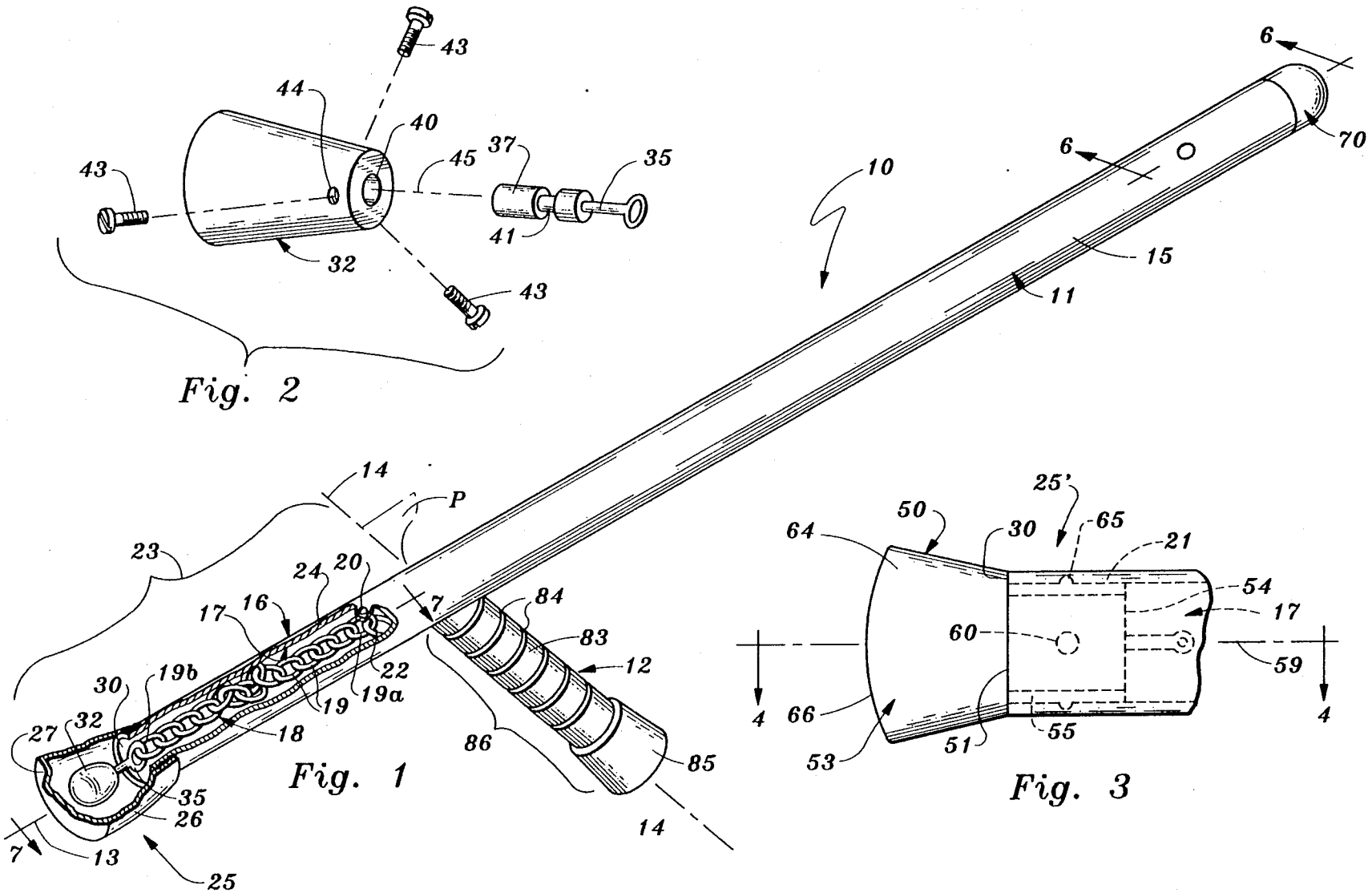
FIG. 1 is a perspective view of a crosshandled baton of the invention partially cut-away to illustrate a threshold cavity into which a metal strap in the form of a chain is stowed in the inactive state for baton operations, such strap having ends fixedly secured to an end wall of the cavity and to a weighted end cap wherein the end cap has exterior threads for attachment to the near end of the baton and an anchor segment at its interior.
FIG. 2 is an enlarged perspective detail of the anchor segment of the weighted end cap of FIG. 1 illustrating how the strap is swivelly attached relative to the end cap.
FIG. 3 is a side view of an alternate end cap of the baton of FIG. 1 attached to the near end of the latter and including a series of spring-loaded balls releasably attached to a vee-shaped race in the side wall of the threshold cavity.

FIG. 1 is a perspective view of a crosshandled baton 10 of the invention. The crosshandled baton 10 includes a main branch 11 and a cross branch 12 that have longitudinal axes of symmetry 13, 14, respectively. The axes 13, 14 lie in common plane P and are normal to each other.

Main branch 11 includes a forward segment 15 and a rear segment 16. Note that the demarkation of the forward segment 15 and rear segment 16 is the attachment location of the cross branch 12. As a result, the forward segment 15 is longer than the rear segment 16. The rear segment 16 is partially cut-away to illustrate a cavity 17 into which strap 18 is shown. Such strap 18 is formed of a series of links 19 including a forward end **19*a* fixedly secured to a pin 20 that is fixed to side wall 21 of the cavity 17 adjacent to end wall 22. The strap 18 also has a rear link 19*b* attached to a weighted end cap 25. Note that length of individual links 19 is less than the transverse dimension of the cavity 17 so that the strap 18 folded back upon itself during storage within the cavity 17. The end cap 25 is cylindrical and includes a side wall 26 outwardly flared to terminate at an end wall 27. The end cap 25 also includes threads 28*a* (see FIG. 5) at the interior of the side wall 26. The purpose of the threads 28***a* of the end cap 25: to disconnectably connect the end cap 25 relative to exterior threads 28*b* of side wall 21 of the cavity 17 wherein near end 30 of the cavity 17 is either in an open or closed state. Such open or closed state of the end 30 of the cavity 17 likewise establishes the operating state of the strap 18 (active or inactive) as explained in more detail below.

Figure 5:
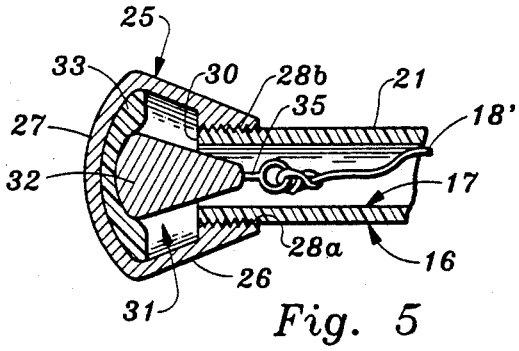
FIG. 5 is an alternate embodiment of the threshold cavity of FIG. 1 in which a plastic or natural fibred rope or line has been substituted for the metal strap of FIG. 1 in which such rope or line is stowed in the inactive state for baton operations, such rope or line being fixedly attached to the weighted end cap that has exterior threads for attachment to the near end of the baton.

As shown in FIGS. 1 and 5, the end cap 25 also includes its own cavity 31 into which an anchor or weight segment 32 is fitted at its interior adjacent to the end wall 27. In order to secure the anchor segment 32 relative to the cavity 31, a moldable plastic insert 33 is formed between the anchor segment 32 and the walls 26, 27 of the end cap 25. A post 35 is seen to extend forward of the anchor segment 32 into contact with rear link 19*b* of the strap 18.

The present invention contemplates two forms of attachment of the following elements of the invention: (i) between the post 35 and the anchor segment 32 ad (ii) between the end cap 25 and near end 30 of the cavity 17 of the rear segment.

As to item (i) above, as shown in FIG. 2, the post 35 is attached to a swivel pivot cylinder 37 that snugly fit within side wall 40 of the anchor segment 32 of FIG. 2. The pivot cylinder 37 has a central slot 41 into which three spaced apart screws 43 penetrate after being mounted to the anchor segment 32 as follows. The screws 43 attach to corresponding threaded openings 44 in the side wall 40 of the anchor segment 32 that are equally spaced about central axis 45. The screws 43 are engineered to allow the pivot cylinder 37 to rotate relative to the anchor segment 32 so that affixing the end cap 25 relative to near end 30 (see FIG. 1) of the cavity 17 (via rotation), does not stress the strap 18 by corresponding rotation. But in FIG. 5, the strap 18' is formed of plastic or natural fibers attached to post 35, the latter being permanently and directly affixed to the anchor segment 32. Even though the strap 18' now rotates in tandem with rotation of the end cap 25, the strap 18' is engineering to accept such stress due to its flexible construction.

As to item (ii), above, as shown in FIGS. 1 and 5, the end cap 25 is threadably attached at the near end 30 of the cavity 17. Such engagement and disengagement relative to the end 30 provides for the two operational states of the crosshandled baton of the invention. In this regard, note that the side wall 26 of the end cap 25 is flared outwardly until intersection with end wall 27 is made. As a result, a strong gripping section generally indicated at 23 is established between the flared end cap 25, thence along outer arcuate surface 24 of the rear segment 26 (of a constant diameter) with termination at the cross branch 12. In this regard, when the user grips the gripping section 23, a side of his palm will be in contact with the flared end cap 25 and as a result a strong gripping section 23 is provided, i.e., the flared nature of that region contributes to a strong grip.

Figure 4:
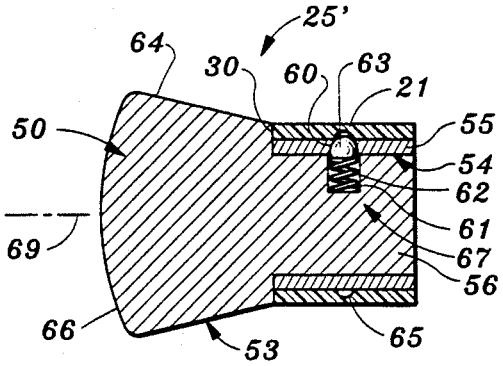
FIG. 4 is a section taken along line 4—4 of FIG 3.

In FIGS. 3 and 4, the end cap 25' includes an elongated cylindrical solid housing 50 having a shoulder 51 that divides the housing 50 into a flared rear section 53 and a forward section 54. The forward section 54 is of less diameter than the rear section 53 and includes an annular band 55 that is collinear of and in surface contact with the side wall 21 of the cavity 17 as well as makes contact with the shoulder 51 of the housing 50 at its intersection with near end 30 of the cavity 17. The band 55 also has a series of radially spaced openings 60. Note in FIG. 4 that each opening 60 is in alignment with a slot 61 in the wall 56 of the forward section 54. The slot 61 provides space to received a spring 62 in end contact with spherical ram 63. The diameter of the opening 60 of the band 55 is less than that of the slot 61 to prevent full escape of the spherical ram 63 from confinement but allows an arc segment of each ram 63 to extend above the band 55 into confinement within a vee-shaped, circumferential groove 65 in the side wall 21 of the cavity 17. Because of the slope of the groove 65, when the insert 63 is within the groove 65, a ram-groove latch generally indicated at 67 is formed wherein the end cap 25' is thereby secured relative to the near end 30 of the cavity 17. The latch 67 has a delatching state, however, wherein the ram 63 can be easily released from such confinement with use of human-engendered force parallel to axis of symmetry 59 of the end cap 25'.

Such engagement and disengagement of the latch 67 provides for the two operational states of the crosshandled baton of the invention. In this regard, note that circumferential outer surface 64 of rear section 53 of the end cap 25' is flared outward until united with end surface 66. As a result, a strong gripping section is established between the flared rear section 53 of the end cap 25'', thence along the side wall 21 (of a constant diameter) and terminating at the cross branch 12, see FIG. 1. In this regard, when the user grips the gripping section of the invention, a side of his palm is in contact with the flared circumferential surface 64 of the end cap 25' and as a result a strong gripping section is provided.

Figure 6:
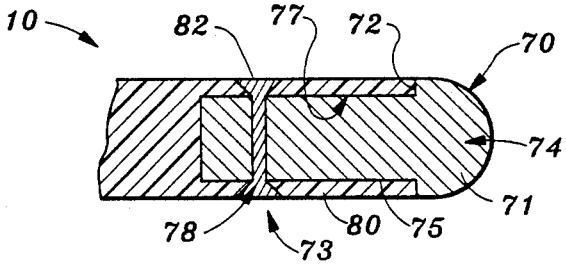
FIG. 6 is a partial section taken along the line 6—6 of the baton of FIG. 1 to illustrate a header cavity at an end of the baton opposite to threshold cavity supporting the metal strap, the header cavity having the capacity to stow a weighted probe.

Returning to FIG. 1, note that forward segment 15 of the main branch 11 includes a head probe generally indicated at 70. As shown in FIG. 6, the probe 70 consists of an elongated cylindrical solid housing 71 having a shoulder 72 that divides the housing 71 into a rear section 73 and a forward section 74. The rear section 73 is of less diameter than the forward section 74 and includes an outer surface 75 in slidable contact with a cavity 77 formed in the forward segment 15 of the baton 10. Attachment is via a pin 78. The pin 78 penetrates through aligned openings (not shown) in sidewall 80 of the cavity 77 and in the rear section 73 of the head probe 70. Ends 82 of pin 78 are enlarged to secured the housing 71 relative to the side wall 80 of the cavity 77.

Figure 7:
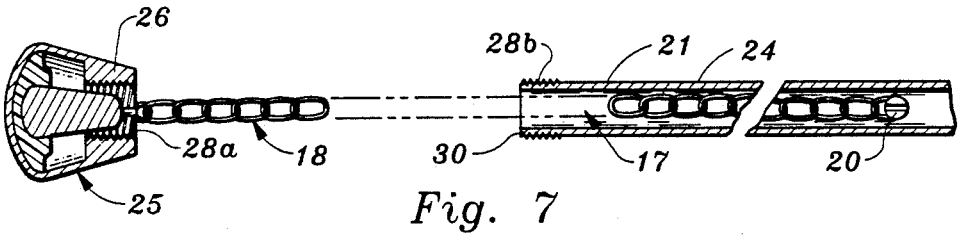
FIG. 7 is a partial longitudinal section taken along line 7—7 of FIG. 1 in which the weighted end cap has been released from threadable contact with the near end of the baton to define the active state of operations.

Features of the straps 18, 18', end caps 25, 25' and weighted head probe 70 of FIGS. 1-6: they allow a suspect to be restrained as when the strap 18, 18' and weighted end cap 25, 25' are used in its active state. In this regard, note that FIG. 7 shows such active state for the end cap 25 and strap 18 of FIG. 1. As shown, the end cap 25 has been delached from the side wall 21 of the cavity 17 and the strap 18 has been allowed to elongate to its full extent. In such active state of baton operation, the strap 18 can easily be tied to an appendage of a suspect for purpose of controlling and/or disarming him. Yet when the strap 18 is in a stowed state as shown in FIG. 1 and the weighted end cap 25 is attached at the near end 30 of the cavity 17 baton 10 via rotational engagement of threads 28*a* in the side wall 26 of the end cap 25 within threads 28*b* at outer surface 24 of the cavity 17, the baton 10 is capable of swinging and jabbing movements for bring about control of such suspects. In this regard, the weight of the head probe 70 of FIG. 6 is engineered to be in balance with the combined weights of the end cap 25 and strap 18. That is to say, such baton 10 provides a suspect jabbing weapon that is highly functional yet in combination with the strap 18 and weighted end cap 25 does not unbalance the baton 10 because the ratio of weights of these elements are in a reasonable range and relationship as explained above.

Returning to FIG. 1, the cross handle 12 is cylindrically shaped and integrally formed with respect to the main branch 11. Also, its outer surface 83 is provided with a series of circumferentially extending grooves 84 and a flared end cap 85 defining a strong gripping section 86 in the manner previously explained. The purpose of the grooves 84 and the cap 85: to provide firm attaching surface for the user's hand during baton use in which a side of the palm of the user is in contact with flared circumerential surface of the end cap 85. That is, the gripping section 86 is established between the flared end cap 85, thence along grooved outer arcuate surface 83 (of a constant diameter) and terminating at the main branch 11, see FIG. 1.

Figure 8:
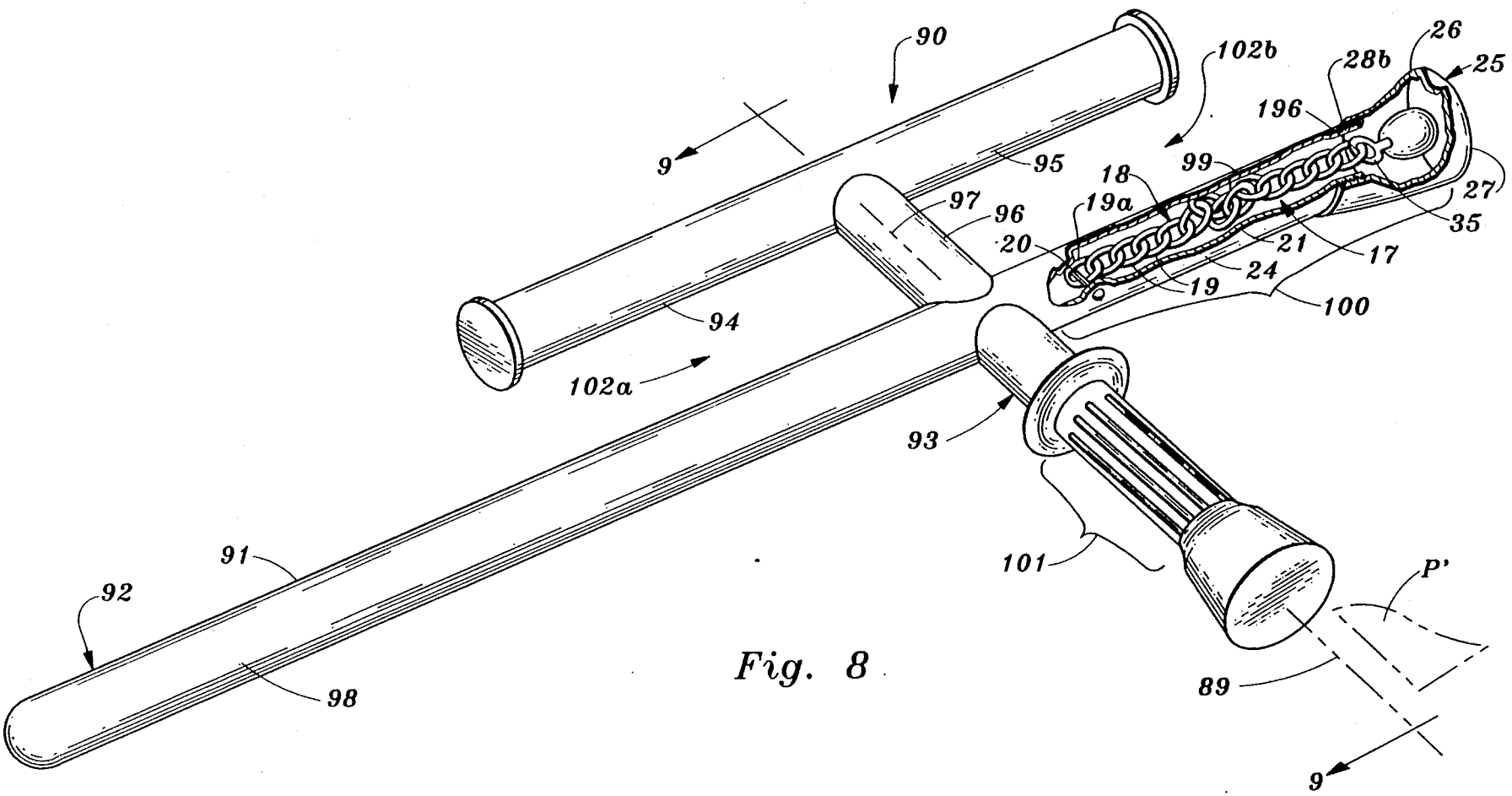
FIG. 8 is a perspective view, partially cut-away, of alternate embodiment of the invention in which the crosshandled baton of FIG. 1 has been modified to provide a Tee-shaped guard offset to a side of the main branch opposite to that from which the crosshandle extends but wherein the crosshandle and main branches define a common plane of bisection, such guard including a pair of parallel arms parallel to the main branch and a transverse arm defining a longitudinal axis of symmetry coincident with that of the crosshandle.

FIG. 8 is a perspective view, partially cut-away, of alternate embodiment of the invention in which the crosshandled baton 10 of FIG. 1 has been modified to provide a Tee-shaped guard 90. Such modified baton is given the number 10' in FIG. 8. As shown, the guard 90 is offset to a side 91 of the main branch 92 opposite to that from which cross branch 93 extends. Note that the main and cross branches 92, 93 and guard 90 define a common plane of bisection. That is, plane P' is coincident with a pair of parallel arms 94, 95 and transverse arm 96 of the guard 90 as well as bisects the main and cross branches 92, 93 of the baton 10'. Note that the transverse arm 96 of the guard 90 defines a longitudinal axis of symmetry 97 coincident with longitudinal axis 89 of the cross branch 93.

Still further with respect to FIG. 8, main branch 92 includes a forward segment 98 and a rear segment 99. The rear segment 99 is partially cut-away to illustrate a cavity 17 into which the strap 18 previously mentioned is stowed. As previously discussed, when the strap 18 is positioned fully within the cavity 17 and end cap 25 is attached to threads **28*b* at the outer surface 24 of the side wall 21 of the cavity 17, the strap 18 and end cap 25 are said to be in an inactive state of baton operations. The attachment of the strap 18 is as before mentioned: Such strap 18 is formed of a series of links 19 including a forward end link 19*a* fixedly secured to a pin 20 that is fixed to side wall 21 of the cavity 17. The strap 18 also has a rear link 19*b* attached to post 35 of the end cap 25. The end cap 25 is cylindrical and includes flared side wall 26 and end wall 27. The purpose of the flared end cap 25: to provide a convenient and strong gripping surface generally indicated at 100** for the user in the manner previously described.

The guard 90 has the capacity to fend off swinging blows from an agressor in which the user grips the baton 10' by either the gripping section 100 of the main branch 92 or by the gripping section 101 of the cross branch 12. That is, by gripping the baton 10' of FIG. 8 at gripping sections 100 or 101, a pair of U-shaped traps generally indicated at **102*a*, 102*b* have been found to provide the user with capability to fend off blows from an agressor. The following defines the limits of the U-shaped traps 102*a*, 102*b*: (i) between arm 94, along transverse arm 96 and a portion of the forward segment 98 of the main branch 92 that is coextensive of the arm 94 of the guard 90; and (ii) between arm 95, along transverse arm 96 and a portion of the rear segment 99 of the main branch 92 that is coextensive of the arm 95**.

Figure 9:
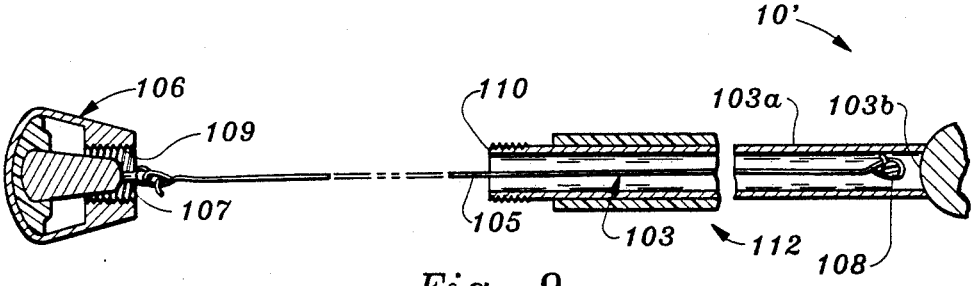
FIG. 9 is a section taken along line 9—9 of FIG. 8 illustrating the coincidence of the axes of symmetry of the transverse arm of the Tee-shaped guard and the crosshandle as well as illustrating a second cavity formed in the crosshandle into which a plastic or natural fibered rope or line (previously stowed in the inactive state) has been elongated to an active state for baton operations, such line or rope having ends fixedly secured to an end wall of the cavity and to a weighted end cap wherein the end cap has exterior threads for attachment to the near end of the crosshandle and an anchor segment at its interior.

FIG. 9 illustrates a modification of the baton 10' of FIG. 8 in which cross branch 12' is provided with a second cavity 103 defined by side wall **103*a* and end wall 103*b*. In FIG. 9, a plastic or natural fibered line or rope 105 is shown in elongated state in which end cap 106 has been decoupled from the side wall 103*a* of the cavity 103. The end cap 106 is weighted and is of the same construction as end cap 25 of FIG. 1 and hence will not be further described except to say, that pin 107 is use to secure line or rope 105 thereto. The other end of the line 105 is secured within the cavity 103 to a radially extending pin 108. Note that the end cap 106 has interior threads 109 for disconnectable attachment to near end 110 of the cavity 103 to either close off or open the near end 110 for use of the line 105. In use, the line or rope 105 and weighted end cap 106 serve as a reserve restraint and are only used if the main strap 18 of the baton 10' of FIG. 8 in unavailable for use. Note also that the line or rope 105 and weighted end cap 106 also remain in an inactive state until needed, i.e., the rope 105 remains stowed with the second cavity 103** until needed.

Figure 10:
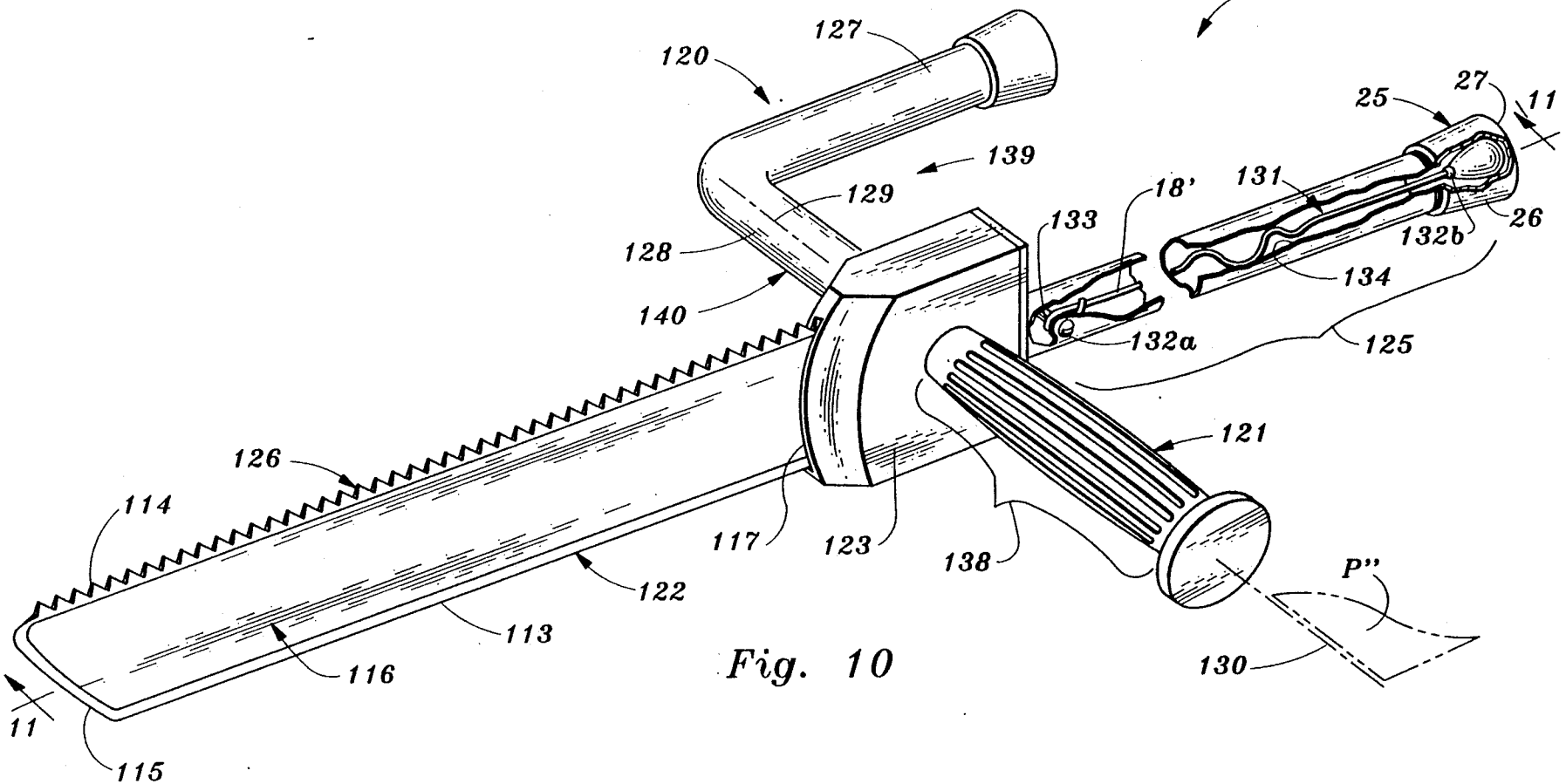
FIG. 10 is a perspective view, partially cut-away, of yet another alternate embodiment of the invention in which the main and crosshandle branches still define a common plane of bisection but wherein (i) the main branch has been modified to provide a central hub, a longitudinally extending forward segment that includes a blade having sharped parallel and end edges, a longitudinally extending rear handle segment that includes a cavity into which a plastic or natural fibered strap is stowed in the inactive state for baton operations, and (ii) a L-shaped guard is provided offset to a side of the central hub opposite to that from which the crosshandle extends, such guard including a first arm parallel to the forward and rear segments of the main branch and a transverse arm defining a longitudinal axis of symmetry coincident with that of the crosshandle.

FIG. 10 is a perspective view, partially cut-away, of still another embodiment of the invention in which the crosshandled baton 10 of FIG. 1 has been modified to provide modified baton 10''. Such baton 10'' includes the following: (i) an L-shaped guard 120 opposite to cross branch 121 and (ii) a bladed segment 122 forward of central hub 123 that is a part of main branch 126 of the modified baton 10'' there depicted.

L-shaped guard 120 is offset from both the central hub 123 and gripping section 125 of main branch 126. It direction of excursion relative to the central hub 123 is opposite to that of the cross branch 121. Note that the cross and main branches 121, 126 define a common plane of bisection P'' that bisects the guard 120, the cross branch 121, and the gripping section 125 and the bladed segment 122 of the main branch 126. With particular regard to the guard 120, note that the bisection plane P'' is coincident with parallel leg 127 and transverse leg 128. Note that the transverse leg 128 terminates in fixed contact with central hub 123 and defines a longitudinal axis of symmetry 129 coincident with longitudinal axis 130 of the cross branch 121.

Still further with respect to FIG. 10, note that the gripping section 125 of the main branch 126 is there partially cut-away to illustrate a cavity 131 into which the strap 18' previously mentioned, is stowed. As previously discussed, the strap 18' and end cap 25 are positioned in an inactive state for baton rouge operations. The attachment of the strap 18' is as before mentioned: Such strap 18' is formed of a series of plastic or natural fibers and include a forward end **132*a* fixedly secured to a pin 133 that is fixed to sidewall 134 of the cavity 131. The strap 18' also has a rear end 132*b* attached to weighted end cap 25 previously described. The end cap 25 is cylindrical and includes side wall 26 outwardly flared to terminate at an end wall 27. The purpose of the flared end cap 25: to provide a convenient and strong gripping surface generally indicated at 125** for the user in the manner previously described.

Figure 11:
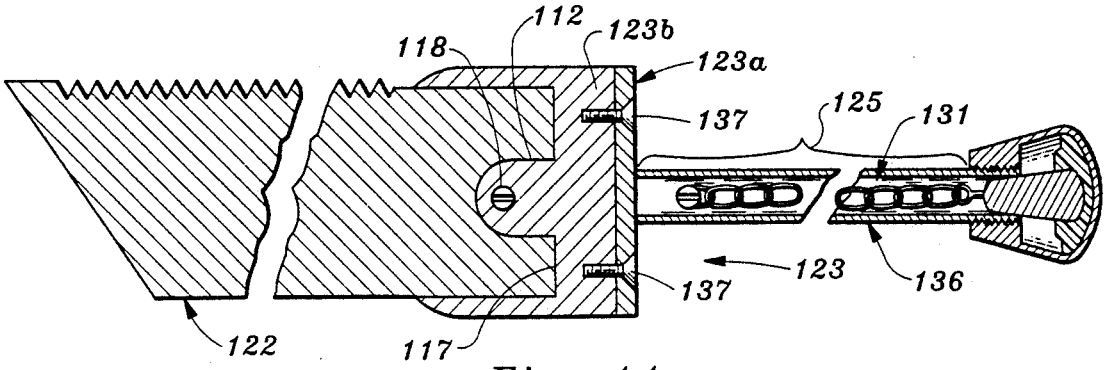
FIG. 11 is a section taken along line 11—11 of FIG. 10.

Bladed segment 122 of general rectangular cross section and includes sharpened side edges 113, 114 and an end edge 115 radiating in three different directions with respect to a central region 116. The bladed segment 122 also has a near end 117 opposite to sharpened end edge 115 that is fixedly attached to the central hub 123 in the manner depicted in FIG. 11, viz., wherein a fastener 118 extends through aligned openings (not shown) in the end 117 of the bladed segment 122 and a projecting lip 112 of the central hub 123. Such attachment is facilitated by forming end wall 123*a* of the hub 123 integral with the cavity 131 and gripping section 125 of the rear segment 136 of the main branch 126 and attaching the former to associated wall 123*b* of the hub 123 using screws 137. In that manner both the bladed segment 122 and the gripping section 125 and cavity 131 are constructed to cantelever from central hub 123 as shown. The direction of the cantelevering of the bladed segment 122 is opposite to that of the gripping section 125. Since the edges 113–115 are quite sharp and dangerous, usage of the baton 10" of the invention, should only occur under dire circumstances that warrant the used of deadly force.

The guard 120 has the capacity to fend off swinging blows from an agressor in which the user grips the baton 10" of the invention by either the gripping section 125 of the main branch 126 or by the gripping section 138 of the cross branch 121. That is, by gripping the baton 10" of FIG. 10 at gripping section 138, a U-shaped trap generally indicated at 139 is formed. The following defines the limits of the u-shaped trap 139: between leg 127, along transverse leg 128 and a portion of the gripping section 125. Note that an additional side deflector generally indicated at 140 is formed by the outward direction of the leg 128 of the guard 120 relative to the central hub 123. The deflector 140 serves the same purpose as the trap 139 previously mentioned.

The above description contains several specific embodiments of the invention. It is not intended that such be constructed as limitations on the scope of the invention, but merely as examples of preferred embodiments. Persons skilled in the art can envision other obvious variations and combinations within the scope of the description. Hence the scope of the invention is to be determined by the appended claims and their legal equivalents.

What is claimed is:

1. A police baton comprising an elongated main branch defining a longitudinal axis, a first end and a second end coextensive of said longitudinal axis, a cross branch of length less than said elongated main branch, said cross branch attached to said main branch at a first side thereof at a location that is spaced closer to said first end than said second end of said main branch and defining a longitudinal axis substantially normal to that of said main branch, said main branch including cavity means having an open end, a closed end and a side wall defining an axis of symmetry coincident with said longitudinal axis of said main branch, said main branch also including a strap stowable within but releasably disconnectable relative to said cavity means through and as function of operating state of said open end to define first and second operating states for said baton, and guard attached to said main branch at a second side opposite to said first side, said guard defining a bisecting plane that also longitudinally bisects said main and cross branches, said guard being L-shaped as defined by said bisecting plane and including a pair of parallel arms parallel to said main branch and a transverse arm having a longitudinal axis of symmetry coincident with that of said cross branch.

2. The police baton of claim 1 with the addition of a weighted end cap disconnectably connected to said open end of said cavity means.

3. The police baton of claim 2 in which said strap includes a first end fixedly connected to said weighted end cap and a second end fixedly connected to said main branch adjacent to said closed end of said cavity means.

4. The police baton of claim 3 in which said strap is a metal chain having an end-to-end length longer than a longitudinal dimension of said cavity means but having links of less length than a transverse dimension of said cavity means whereby said chain can be foldable stowed within said cavity means in said first operating state of said baton but releasable from said cavity means as a function of relative movement between said end cap and said cavity means, to elongate to a substantial length and define said second operating state of said baton whereby a suspect can easily be controlled and/or disarmed.

5. The police baton of claim 3 in which said strap is a fibrous, woven line having an end-to-end length longer than a longitudinal dimension of said cavity means but having sufficient flex whereby said line can be foldable stowed within said cavity means in said first operating state of said baton but releasable from said cavity means as a function of relative movement between said end cap and said cavity means, to elongate to a substantial length and define said second operating state of said baton whereby a suspect can easily be controlled and/or disarmed.

6. The police baton of claim 5 in which said line is plastic.

7. The police baton of claim 2 in which said end cap that disconnectably connects to said open end of said cavity means is cylindrical and includes a closed end, an open end and a side wall that flares outward from said open end toward said closed end, said side wall also being fitted with threads for rotational engagement with said side wall of said cavity means.

8. The police baton of claim 7 in which flared side wall of said end cap defines a portion of a gripping region formed between said end cap and said cross branch.

9. The police baton of claim 2 in which said end cap that disconnectably connects to said open end of said cavity means includes a circumferential wall having a first enlarged end portion, a shoulder defining mid-portion and a second reduced end portion connected to said enlarged end portion through said mid portion, said second reduces end portion of said circumferential wall including a spring-loaded ram latch for disconnectably applying and releasing radially directed friction pressure at an arcuate, sliding surface of circular cross section formed between said circumferential wall and said side wall of said cavity means.

10. The police baton of claim 9 in which said latch includes a set of openings circumferentially spaced about said second reduced end portion of said wall of said end cap, springs seated in said set of openings, and series of radially directed rams in contact with said springs whereby said rams are biased by said springs to extend radially across said arcuate sliding surface formed between said circumferential wall of said end cap and said side wall of said cavity means and prevent relative movement therebetween.

11. The police baton of claim 1 with the addition of a second cavity in said main branch located at said second end thereof and a weighted head probe permanently affixed within said second cavity.

12. The police baton of claim 11 in which said weighted head probe includes an enlarged, bulbous end and a reduced central section affixed within said second cavity, said head probe having a weight W3 that is related to the weight W1 of said end cap and to weight W2 of said strap to provide surprising good balance during both first and second operating states of said baton.

13. The police baton of claim 12 in which if R1 is the ratio of W1/W2 and R2 is the ratio of W+W2/W3, then R1 is about equal to R2 to provide a balanced baton.

14. A police baton comprising an elongated main branch defining a longitudinal axis, a first end and a second end coextensive of said longitudinal axis a cross branch of length less than said elongated main branch, said cross branch attached to said main branch at a first side thereof at a location that is spaced closer to said first end than said second end of said main branch and defining a longitudinal axis substantially normal to that of said main branch, said main branch including cavity means having an open end, a closed end and a side wall defining an axis of symmetry coincident with said longitudinal axis of said main branch, said main branch also including a strap stowable within but releasably disconnectable relative to said cavity means through and as function of operating state of said open end to define first and second operating states for said baton, said first end at said main branch including an elongated first end section comprising a central hub positioned at said location of attachment of said cross and main branches and a blade segment appended to and cantilevered from said central hub, said blade segment including parallel, sharpened side edges and a sharpened end edge opposite to attachment between said blade segment and central hub.

* * * * *